US005739808A

United States Patent [19]

Suga et al.

[11] Patent Number: 5,739,808

[45] Date of Patent: Apr. 14, 1998

[54] DISPLAY CONTROL METHOD AND APPARATUS

[75] Inventors: Kazumi Suga, Tokyo; Hiroshi Inoue, Yokohama, both of Japan

[73] Assignee: Canon Kabushiki Kaisha, Tokyo, Japan

[21] Appl. No.: 547,807

[22] Filed: Oct. 25, 1995

[30] Foreign Application Priority Data

Oct. 28, 1994 [JP] Japan ..... 6-265441

[51] Int. Cl.[6] ..... G09G 5/10

[52] U.S. Cl. ..... 345/147; 245/89; 245/132; 245/3

[58] Field of Search ..... 345/3, 132, 29, 345/147, 148, 149, 89, 87; 358/455, 456, 457, 458, 459

[56] References Cited

U.S. PATENT DOCUMENTS

| | | | |
|---|---|---|---|
| 4,776,676 | 10/1988 | Inoue et al. | 350/350 |
| 4,830,467 | 5/1989 | Inoue et al. | 350/333 |
| 4,924,522 | 5/1990 | Bray et al. | 345/149 |
| 4,930,875 | 6/1990 | Inoue et al. | 350/333 |
| 4,990,902 | 2/1991 | Zenda | 345/132 |
| 5,033,822 | 7/1991 | Ooki et al. | 340/331 T |
| 5,034,735 | 7/1991 | Inoue et al. | 340/784 |
| 5,041,821 | 8/1991 | Onitsuka et al. | 340/784 |
| 5,058,994 | 10/1991 | Mibara et al. | 359/56 |
| 5,066,945 | 11/1991 | Kanno et al. | 340/784 |
| 5,091,723 | 2/1992 | Kanno et al. | 340/784 |
| 5,113,181 | 5/1992 | Inoue et al. | 350/783 |
| 5,146,558 | 9/1992 | Inoue | 395/166 |
| 5,182,549 | 1/1993 | Taniguchi et al. | 340/784 |
| 5,253,340 | 10/1993 | Inoue | 395/163 |
| 5,293,540 | 3/1994 | Trani et al. | 348/584 |
| 5,317,332 | 5/1994 | Kanno et al. | 345/101 |
| 5,337,160 | 8/1994 | James | 345/132 |
| 5,379,051 | 1/1995 | Suga et al. | 345/97 |
| 5,463,478 | 10/1995 | Makita et al. | 358/455 |
| 5,465,102 | 11/1995 | Usui et al. | 345/89 |
| 5,483,634 | 1/1996 | Hasegawa | 395/162 |

FOREIGN PATENT DOCUMENTS 0574142 12/1993 European Pat. Off. .

OTHER PUBLICATIONS

IBM Technical Disclosure Bulletin, vol. 32, No. 5A, Oct. 1989, New York, US, pp. 194–197, XP000048884 "Halftoning Method for Mosaic Color Displays Using Error Diffusion" * p. 195, line 10–line 28*.

*Primary Examiner*—Dennis-Doon Chow

*Attorney, Agent, or Firm*—Fitzpatrick,Cella,Harper & Scinto

[57] ABSTRACT

The present invention is to provide a display control method and apparatus which can display a high-quality image excellent in a gradation even if a resolution of a display device is higher than that of an input image. The display control apparatus which displays input image data of a first resolution on a display device of which a second resolution is higher than the first resolution comprises a calculation circuit for calculating a ratio of the first resolution to the second resolution, a determination circuit for determining the number of gradations on the basis of the ratio in case where the display device displays one pixel data of the input image data to a processing circuit for halftone processing the input image data to produce a value of the number of gradations determined by the a determination circuit and a data conversion circuit for converting the halftone-processed image data into data having a form which can be displayed on the display device.

20 Claims, 18 Drawing Sheets

| | | | | |
|---|---|---|---|---|
| | | * | 2/8 | 1/8 |
| 1/8 | 1/8 | 2/8 | 1/8 | |

TERNARIZATION HALFTONE PROC

CONVERSION INTO BINARY DISPLAY DEVICE OUTPUT FORMAT

OUTPUT TO BINARY DISPLAY DEVICE

INPUT IMAGE DATA (8 BITS)

7-LEVEL GENERATION HALFTONE PROC

IMAGE DATA AFTER 7-LEVEL GENERATION HALFTONE PROC

CONVERSION INTO 4-LEVEL DISPLAY DEVICE OUTPUT FORMAT

4-LEVEL DISPLAY DEVICE OUTPUT DATA

OUTPUT TO 4-LEVEL DISPLAY DEVICE

4-LEVEL DISPLAY DEVICE

DISPLAY CONTROL METHOD AND APPARATUS

BACKGROUND OF THE INVENTION

1. Field of the Invention

The present invention relates to display control method and apparatus for controlling a display of display device, and more particularly to display control method and apparatus for controlling gradation number to be displayed on a display device in accordance with a resolution of input image data.

2. Related Background Art

Hitherto, a CRT display has been widely used for a television set or a computer display, however, since the length in a thickness direction of thickness of a display screen (inside depth) is required some extent in the CRT display, it is difficult to miniaturize an entire size of the display device. Therefore, as the display device for compensating such a defect, a liquid crystal display (referred to as an LCD hereinafter) has been appeared.

As of today, some systems can be found as the LCD, however, the system can be classified into about two systems. That is, one is an active matrix system and the other is a simple matrix system. As the active matrix system, a system which has a TFT (thin film transistor) every pixel is usually utilized. As this system can perform an analog gradation display, it is possible to perform a full color display. However, this system has such problems as increasing of the cost and hard realizing of a large screen.

On the other hand, for example, the simple matrix system utilizing a ferroelectric liquid crystal or the like can easily realize the large screen with the low cost. However, since an image is expressed basically by displaying of one bit for each of RGB colors, the color representation becomes poor. Therefore, as the technology for compensating such poor color representation, the following method is proposed. That is, a binarization halftone process such as an error diffusion method, a dither method or the like is executed to input data to perform a pseudo halftone display by a binary display device.

A ferroelectric liquid crystal display (referred to as an FLCD hereinafter) utilizing a ferroelectric liquid crystal (referred to as an FLC hereinafter) differs from another liquid crystal display in the feature that the FLCD has a memorability (memorizing ability). This means such characteristic as a liquid crystal holds a displaying state varied by an applying of electrical field. Depending on such memorability, a contrast of the display which utilizes the FLC is not deteriorated even if the number of scanning lines becomes large. Therefore, a fine and excellent displaying can be realized with a large-size screen. By utilizing thus feature, up to today, the FLCD has been widely applied to a display of DTP (desk top publishing) system or the like. However, an FLCD panel can only express two states of bright and dark by one pixel, therefore, in case of displaying an image including the large number of gradations and colors as in a TV image, the number of gradations and colors have to be increased by the combination of plural pixels by executing a binarization image process which is, for example, represented by "an error diffusion process".

As to the technology for displaying on the FLCD an image which is binarization processed by using the error diffusion method, the present applicant filed U.S. patent application No. 246,720 on May 20, 1994, now U.S. Pat. No. 5,543,885, No. 243,929 on May 17, 1994, now U.S. Pat. No. 5,463,478, No. 248,511 on May 24, 1994, No. 246,724 on May 20, 1994, No. 061,026 on May 14, 1993 now U.S. Pat. No. 5,585,818, and No. 062,214 on May 18, 1993, now U.S. Pat. No. 5,433,634.

However, in a case where a horizontal resolution and a vertical resolution of a binary display device are respectively N times and M times as large as those of an input image, in the above-mentioned pseudo halftone displaying method, an image is displayed on the binary display device by executing the binarization halftone process after interpolating an input image or copying the same data such that the horizontal resolution and the vertical resolution of the input image become the same as those of the display device. Therefore, there occurs such a problem as an excellent image can not be obtained in spite of the high resolution of the display device.

SUMMARY OF THE INVENTION

The present invention can eliminate the above-mentioned defect of the prior art, and an object of the present invention is to provide display control method and apparatus which can display a high-quality image excellent in a gradation even if a resolution of a display device is higher than that of an input image.

Another object of the present invention is to provide display control method and apparatus which can display a high-quality image by expressing the gradation utilizing N×M pixels of the display device in a case where a horizontal resolution of the display device is N times as large as that of input image data and a vertical resolution of the display device is M times as large as that of input image data.

Another object of the present invention is to provide display control method and apparatus which can display a high-quality image in a case where a display resolution of an FLCD is higher than that of an input image.

Still another object of the present invention is to provide display control method and apparatus which can renew a frame at a high speed even if a frame renewal rate of the display device is in a lower level as in the FLCD, and more particularly, to provide display control method and apparatus which can display a smooth animating image in case of displaying an animation image.

To attain the above objects, according to the present invention, as to the horizontal direction, a multi-gradationing process (increasing the number of gradation) is executed such that the resolution of input image data coincides with the resolution of the display device and as to the vertical direction, multi-gradationing processed data is driven for plural lines simultaneously such that the resolution of input image data coincides with the resolution of the display device.

The above and other objects of the present invention will become apparent from the accompanying drawings and the following detailed description based on the drawings.

DETAILED DESCRIPTION OF THE PREFERRED EMBODIMENTS

The preferable embodiment of the present invention will be described in detail hereinafter with reference to the accompanying drawings.

Figure 1:
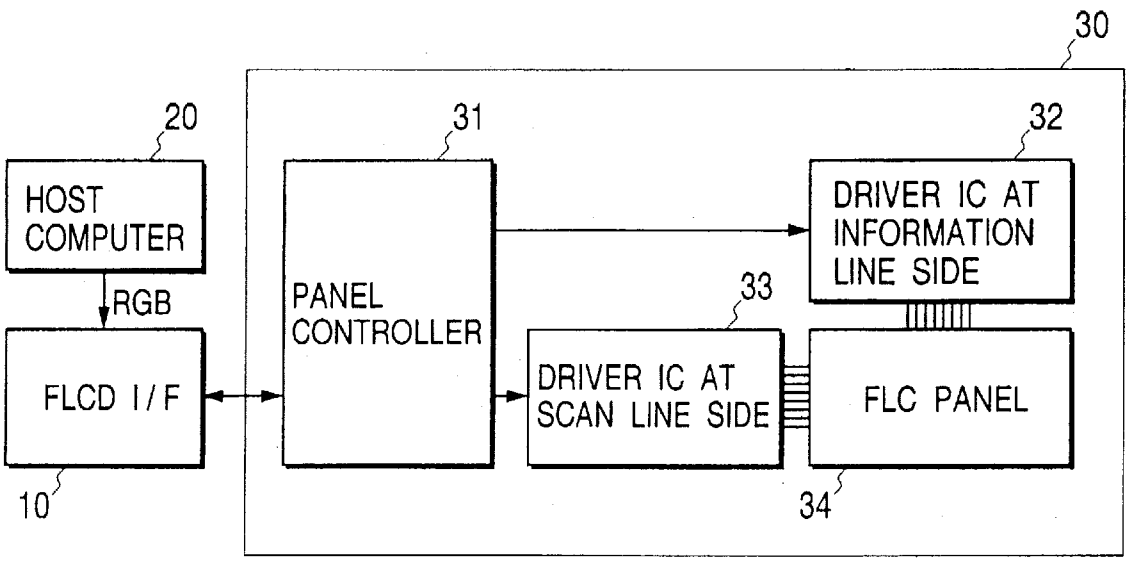
FIG. 1 is a block diagram showing the structure of a display system according to the embodiment of the present invention.

FIG. 1 is a block diagram of a display system to which a display control apparatus corresponding to an embodiment of the present invention is applied. In FIG. 1, reference numeral 30 denotes a ferroelectric liquid crystal display (FLCD). An FLC panel 34 has electrodes which are arranged in a matrix shape. The panel 34 is manufactured by implanting a ferroelectric liquid crystal between two glass plates opposing to each other. An information electrode and a scanning electrode of the panel 34 are connected to a driver IC 32 and a driver IC 33, respectively. A panel controller 31 controls the panel driving.

In FIG. 1, a host computer 20 produces data to be displayed and an FLCD interface 10 converts an RGB video signal transmitted from the host computer 20 into a signal for the FLCD.

Figure 2:
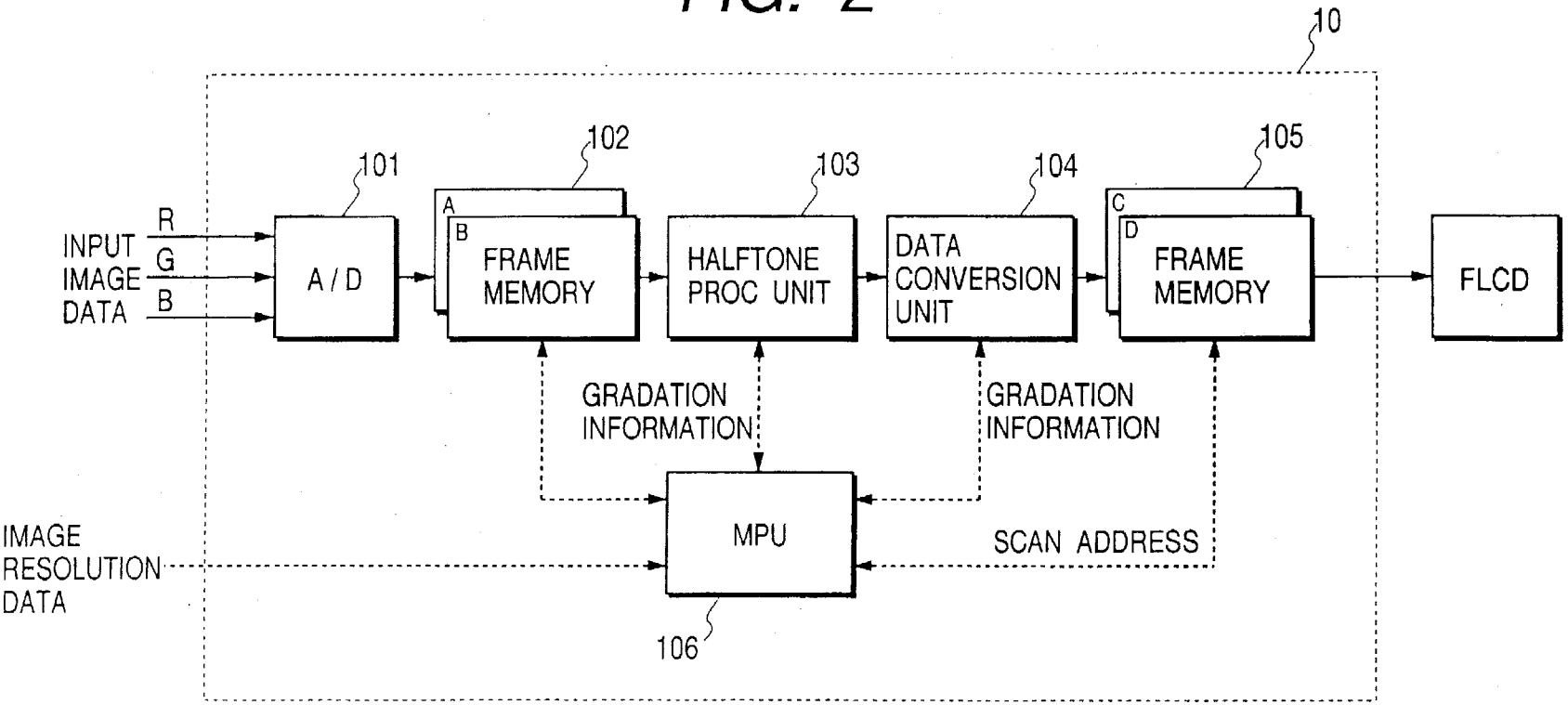
FIG. 2 is a block diagram showing the structure of a display control apparatus according to the embodiment of the present invention.

FIG. 2 is a block diagram showing the structure of the display control apparatus (FLCD interface 10) corresponding to the embodiment of the present invention. In the display control apparatus shown in FIG. 2, image data which is input to the apparatus from the host computer 20 is A/D converted by an A/D conversion unit 101. Then, the A/D converted data is stored in a frame memory 102 in unit of frame.

The timing of writing data in or reading out data from the frame memory 102 is regarded that previous frame data is read out from a frame memory 102B with the same timing as present frame data is stored in a frame memory 102A as described later. However, a timing control of thus sequential writing and reading is performed by a control unit (micro processor unit; MPU) 106.

Beside the above-mentioned function, the control unit 106 obtains a horizontal resolution and a vertical resolution of an input image from the host computer 20 which is in an external of the display control apparatus to calculate that the horizontal resolution and the vertical resolution of a display device become how times as large as those of the input image respectively. Then, when thus calculated result are assumed as integral numbers N and M respectively, a gradation number L which can be expressed by an area-gradation system by utilizing the N×M pixels of a binary display device (FLCD) is determined to supply thus gradation information to a halftone process unit 103 and a data conversion unit 104 described later.

Here, a process for determining the gradation number L from the integral numbers N and M will be described.

Figure 3:
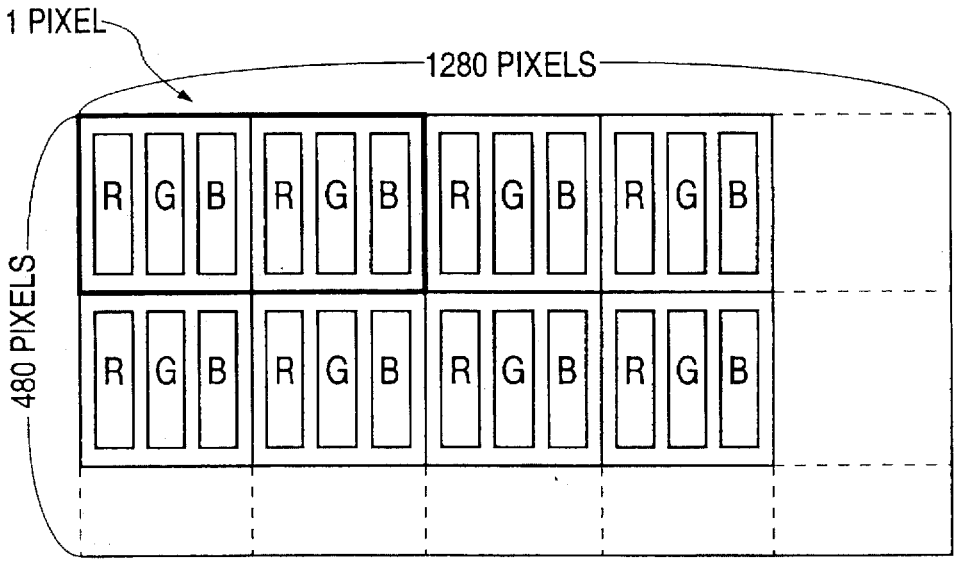
FIGS. 3 to 5 are conceptional views for explaining a first method for determining the gradation number from input image resolution data.
Figure 4:
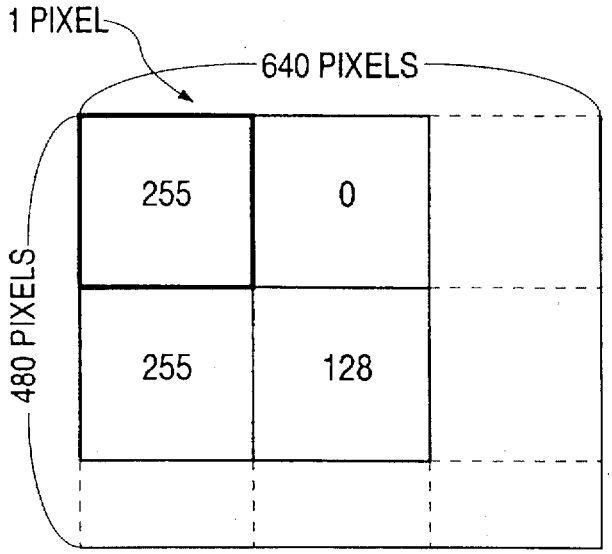
Figure 5:
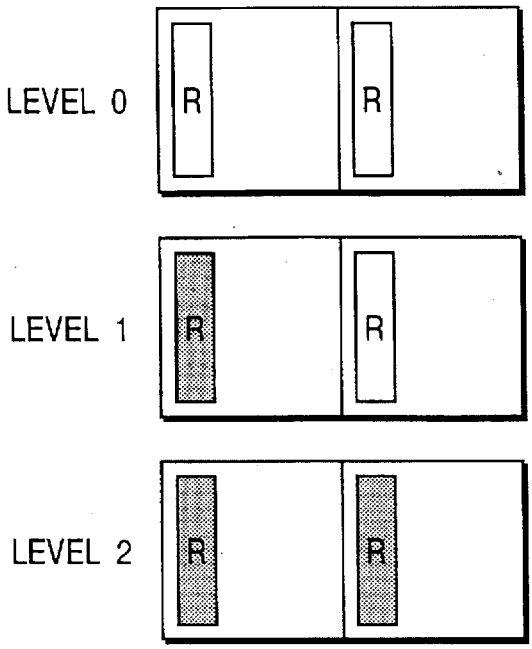

As shown in FIG. 3, the horizontal resolution and the vertical resolution of the display device are 1280 and 480, respectively. As shown in FIG. 4, the horizontal resolution and the vertical resolution of input image data (8-bit digital data) are 640 and 480, respectively. That is, in a case where the horizontal resolution of the display device is twice as large as that of the input image, data of one pixel shown in FIG. 4 can be displayed in a three-gradation display (level 0 to level 2) as shown in FIG. 5 (an image can be displayed with respective three-levels for each of RGB colors) by one pixel in FIG. 3 (original two pixels in the horizontal direction can be used as one pixel).

Therefore, in a case where the horizontal and the vertical resolution of the input image are respectively 640 and 480, the gradation number is determined as "3"

Figure 6:
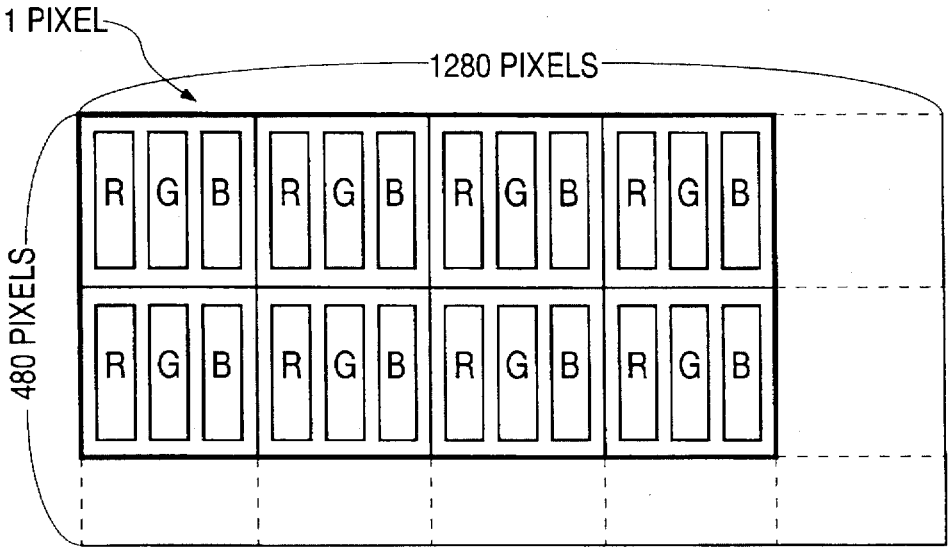
FIGS. 6 to 8 are conceptional views for explaining a second method for determining the gradation number from input image resolution data.
Figure 7:
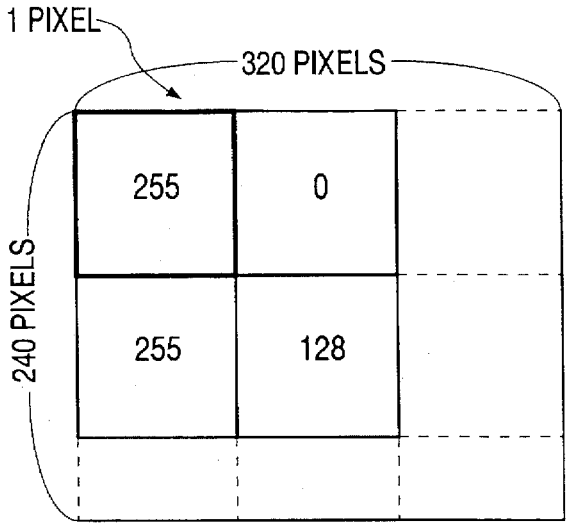
Figure 8:
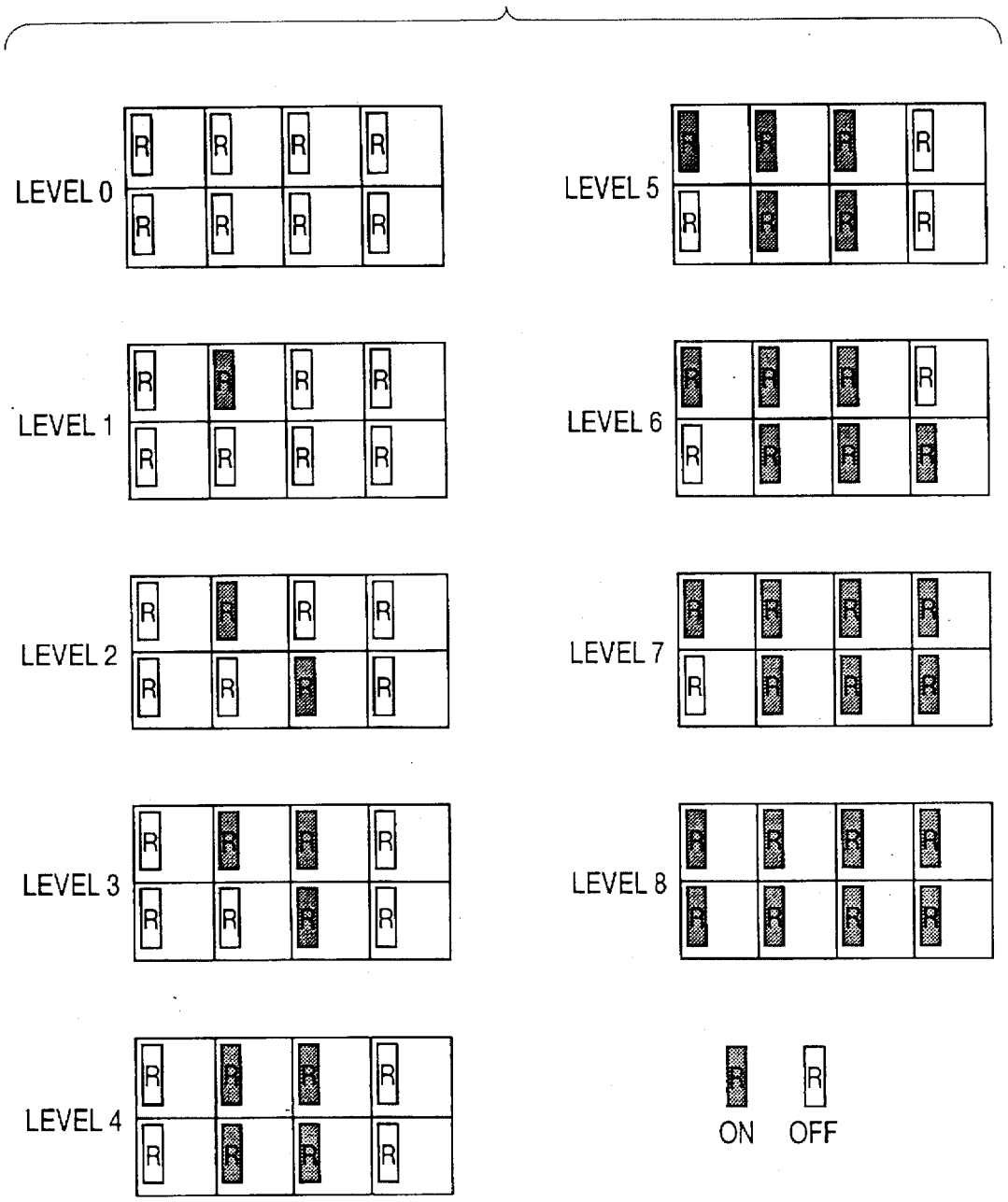

In a case where the horizontal and the vertical resolution of the display device are same as those of the above-mentioned case (respectively 1280 and 480) and the horizontal and the vertical resolution of the input image are 320 and 240 respectively, i.e., the horizontal resolution of the display device is 4 times as large as that of the input image and the vertical resolution of the display device is twice as large as that of the input image, data of one pixel shown in FIG. 7 can be displayed in a nine-gradation display (level 0 to level 8) as shown in FIG. 8 (an image can be displayed with respective nine-levels for each RGB color) by one pixel shown in FIG. 6 (original four pixels in the horizontal direction and two pixels in the vertical direction can be used as one pixel).

Therefore, in case where the horizontal and the vertical resolution of the input image are 320 and 240 respectively, the gradation number is determined as "9".

On the other hand, frame data read out from the frame memory 102 is multi-value halftone processed by the halftone process unit 103 to become the gradation number which is obtained from the main processing unit 106.

Here, it will be explained two-kinds of multi-value halftone processes in a case where the number of gradation is 3, i.e., one process using a ternary error diffusion method and the other process using a ternary dither method.

At first, it will be explained the case where input data is 8-bit data of 0 to 255 (FIG. 9) and the ternary error diffusion method is used as the multi-value halftone process.

Figure 9:
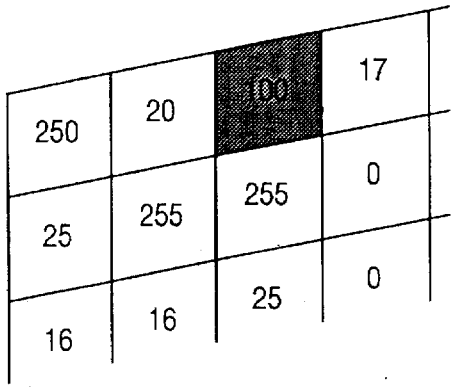
FIG. 9 shows input data in a case where a multi-value halftone process is a multi-value error diffusion method.
Figure 10:
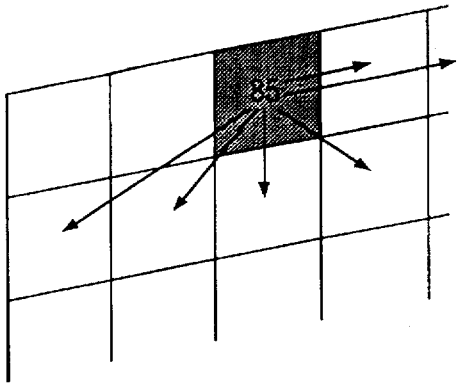
FIG. 10 shows output data in a case where a multi-value halftone process is a multi-value error diffusion method.
Figures 11, 12:
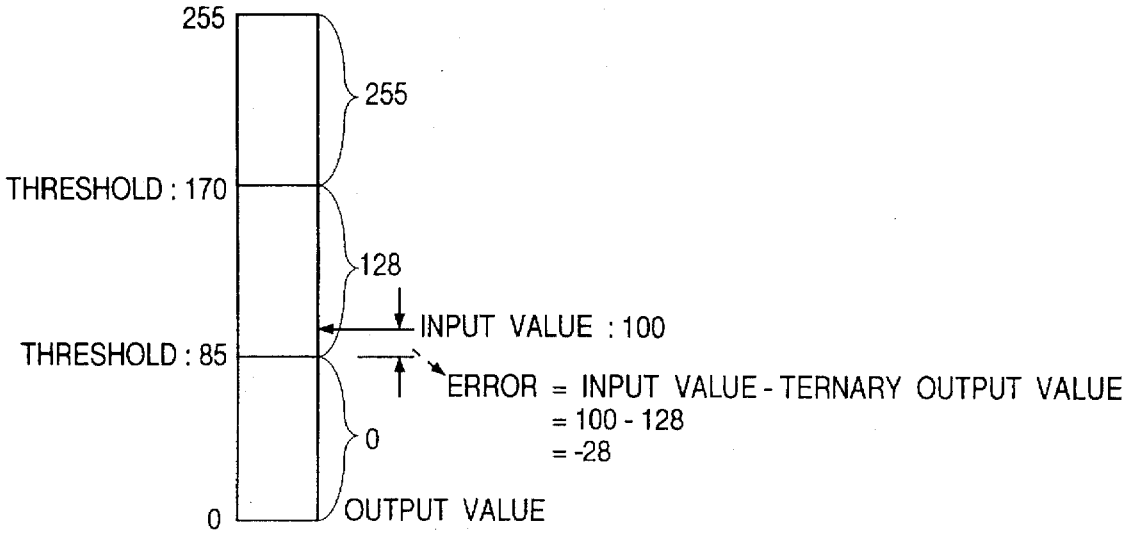
FIG. 11 shows a ternarization table in a case where a multi-value halftone process is a multi-value error diffusion method.
FIG. 12 shows a diffusion matrix in a case where a multi-value halftone process is a multi-value error diffusion method.

In this case, depending on whether the input data is larger or less than two thresholds 85 and 170 of a ternary table shown in FIG. 11, the output value is determined as three values 0, 128 and 255. For example, in a case where the input data is value 100 as shown in FIG. 9, this value 100 is larger than the threshold 85 and less than the threshold 170, therefore, an output value becomes 128. As result, a difference value −28 is appeared as an error between an input value and an output value. However, as shown in FIG. 10, by diffusing this error with performing the weighting shown in FIG. 12 to horizontal and lower direction input image data, a halftone image is macro-expressed.

Next, when the input data is the 8-bit data as mentioned above, it will be explained the case for using a ternary 2×2 dither method as the multi-value halftone process.

Figure 13:
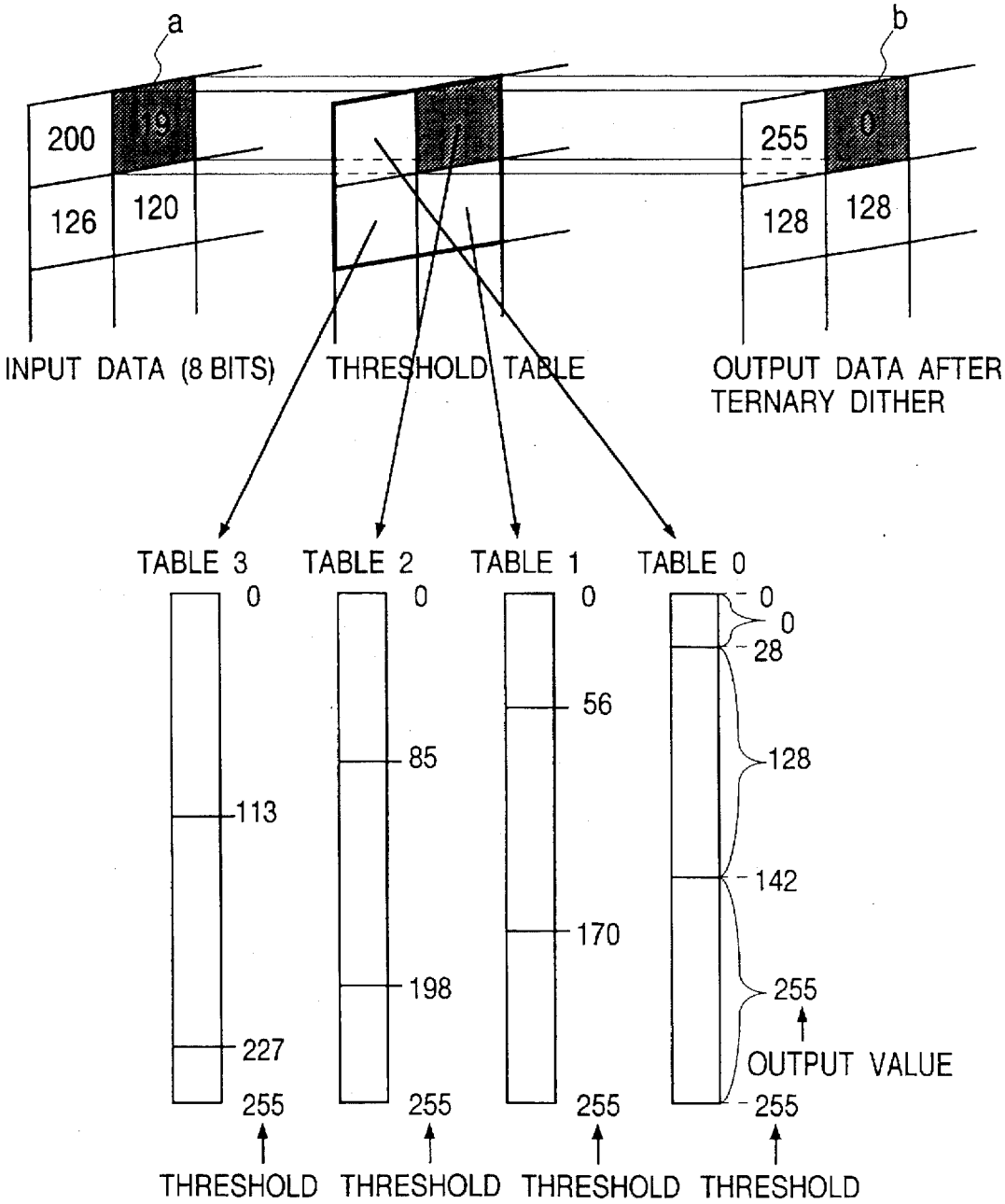
FIG. 13 is a view for explaining the case that a multi-value halftone process is a multi-value dither method.

In a case where a dither matrix of b 2×2is utilized, four kinds of threshold tables (table 0 to table 3) shown in FIG. 13 are set in advance, and two thresholds in each table are all defined to have the same distance each other. The input data is compared with thresholds of above-mentioned four threshold tables in unit of four data of vertical/horizontal 2×2, and an output value is defined.

For example, when the input data is "19" as indicated by symbol a in FIG. 13, since the data "19" is positioned on the right upper of four pixels of 2×2, this data is compared with thresholds 85 and 198 of a threshold table 2. As the value 19 is less than the threshold 85, an output value becomes 0 as indicated by symbol b in FIG. 13.

Data which was multi-value halftone processed by the above-mentioned halftone process unit 103 is converted into ON/OFF data of the binary display device, that is, converted into binary data of '1' or '2'.

Here, it will be explained the conversion for converting data into the ON/OFF data of the binary display device.

Figure 14A:
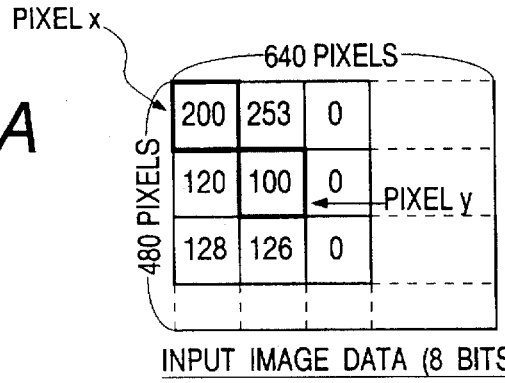
FIGS. 14A to 14D are views for explaining a process in which multi-value halftone processed data is converted into a format which can be output to a binary display device.
Figure 14A:
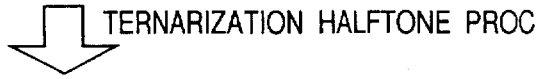
Figure 14B:
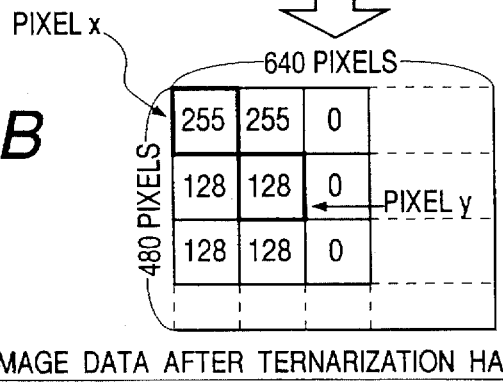
Figure 14B:
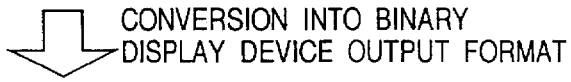
Figure 14C:
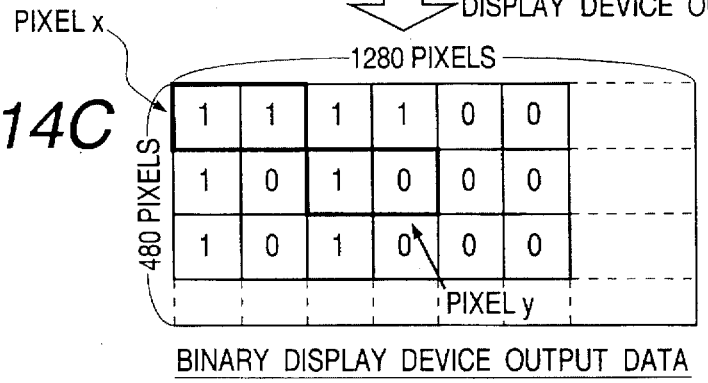
Figure 14C:
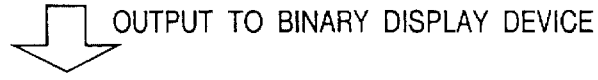

FIGS. 14A to 14D are views for explaining the conversion for converting data into the ON/OFF data of the binary display device in a case where the gradation number is 3 as mentioned above. Among the input image data shown in FIG. 14A, the value of the input image data of a pixel x is 200. When this data is converted into data of 255 by executing a ternary halftone process, since this case corresponds to level 2 of a 3-gradation expression shown in FIG. 5, data is converted into such binary data as the both of two sub-pixels of the binary display device come to be lighted as shown in FIG. 14C (refer to FIG. 14D).

Figure 14D:
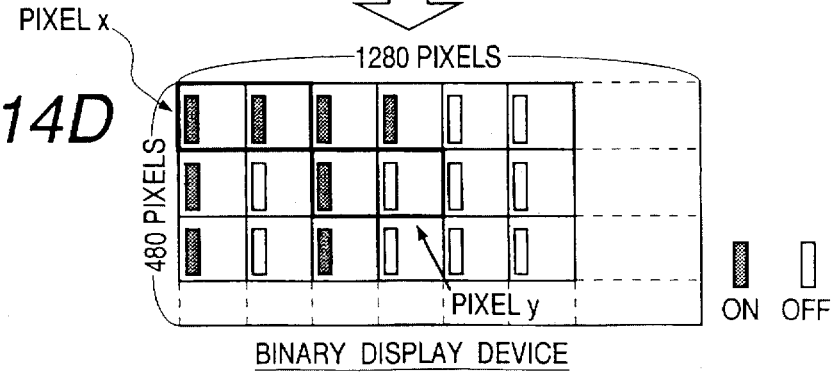

As shown in FIG. 14A, in the case where the value of the input image data of a pixel y is 100, when this data is converted into data of 128 by executing the ternary halftone process, since this case corresponds to level 1 of a 3-gradation expression shown in FIG. 5, data is converted into such binary data as the one of two sub-pixels of the binary display device comes to be lighted as shown in FIG. 14C (refer to FIG. 14D).

However, as to selection which of these two sub-pixels has to be lighted, whichever may be selected to be lighted in advance, or it may be selected such manner as a pixel to be lighted is changed every line.

Data converted by the above-mentioned data conversion unit 104 is written in a frame memory unit 105, however, within the same time, one frame previous data is transferred to the display device.

Here, it will be explained a timing until when data is output to the display device from the halftone process unit 103, with reference to a timing chart shown in FIG. 15.

Figure 15:
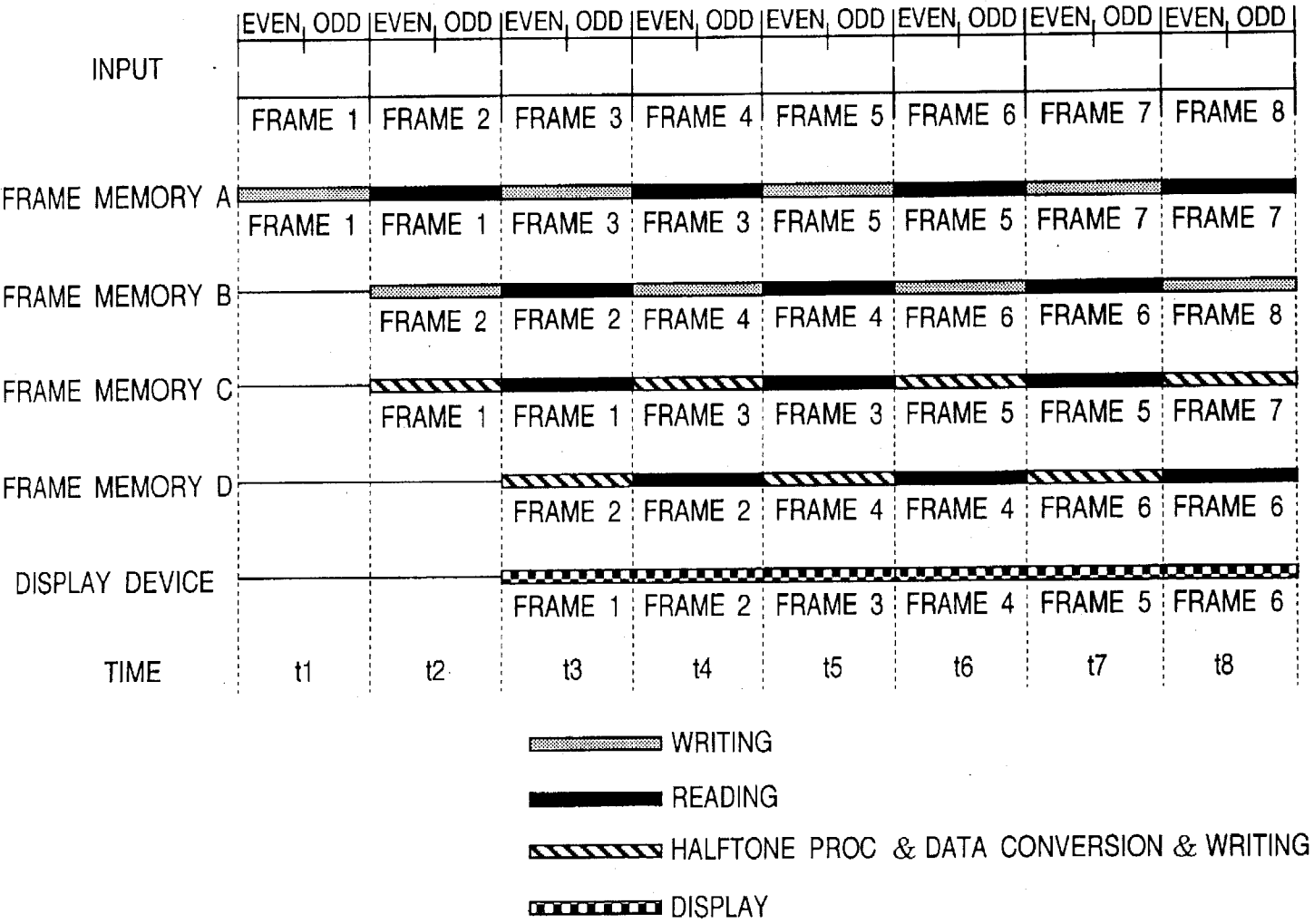
FIG. 15 is a timing chart indicating the period between the state that data is input to a display control apparatus corresponding to the embodiment and the state that data is output to a display device.

In a time slot t2 shown in FIG. 15, data of a frame 1 is read out from the frame memory 102A, and is halftone processed and data converted to be written in a frame memory 105C. In a time slot t3, this data of the frame 1 is read out from the frame memory 105C and is output to the display device.

In the same time slot t3, data of a frame 2 is read out from the frame memory 102B, and is halftone processed and data converted to be written in a frame memory 105D. In a time slot t4, this data of the frame 2 is output to the display device.

As described above, according to the present embodiment, in a case where the horizontal resolution and the vertical resolution of the display device are larger than those of the input image, by executing a process for realizing a multi-value responding to the difference of the resolution to an input image to coincide with the resolution of the display device, there obtains such effect as realizing a computer image or a TV image of which quality is more excellent than that of an image to which an ordinary binarization halftone process is executed after converting the resolution of input image.

Next, the modified examples of the above-mentioned embodiment will be described hereinafter.

<MODIFIED EXAMPLE 1>

As a modified example 1 of the above-mentioned embodiment, in a case where input data is an NTSC signal, it will be explained an example for utilizing a binary display device as a display device.

Figure 16:
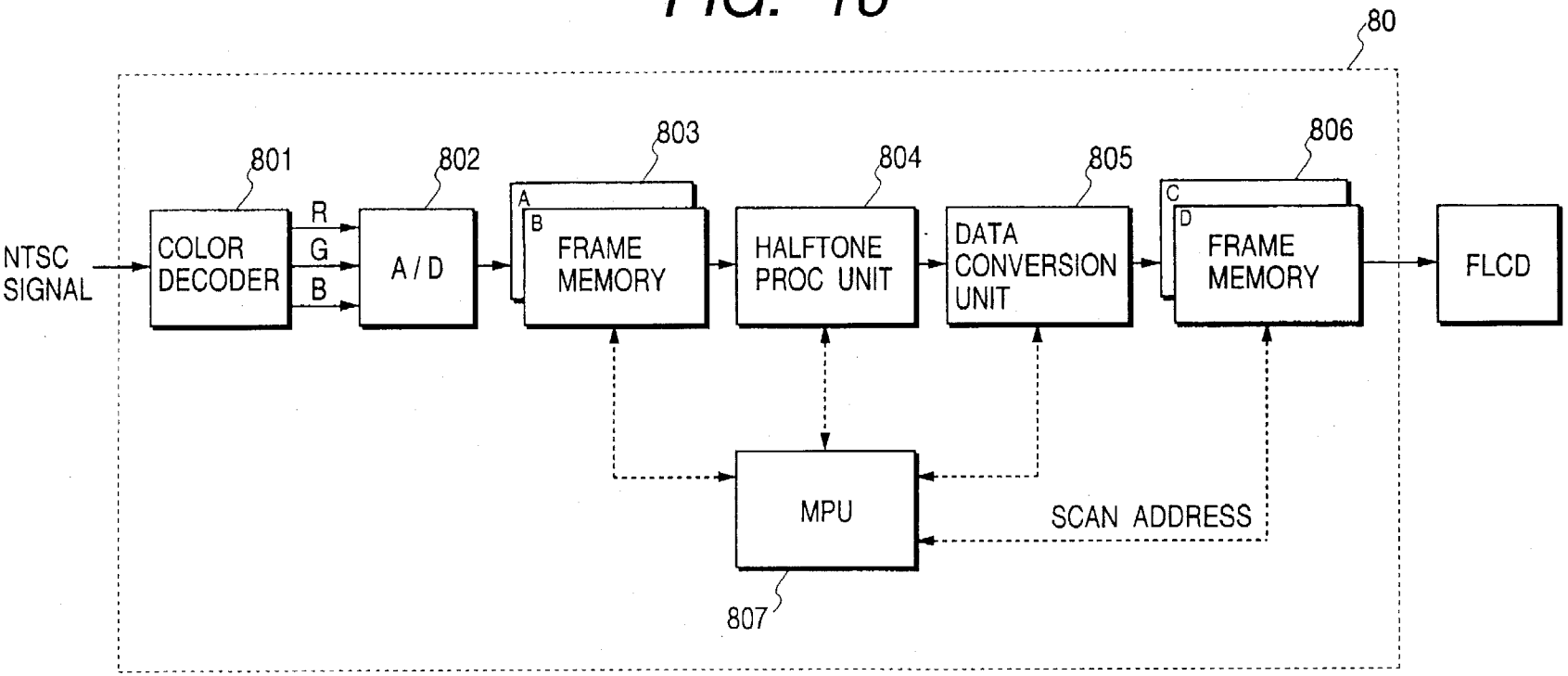
FIG. 16 is a block diagram showing the structure of a display control apparatus corresponding to a modified example 1.

FIG. 16 is a block diagram showing the structure of a display control apparatus 80 corresponding to the present modified example. As shown in FIG. 16, the NTSC signal input to a color decoder 801 is converted into RGB data having horizontal/vertical resolution of 640×480 in the color decoder 801. Then, the RGB data is A/D converted in an A/D conversion unit 802.

Since thus converted RGB data is transmitted in unit of field with 60 Hz, in a frame memory 803 of the next stage, data of even fields are written in every other line from 0th line of the frame memory 803. Then, data of odd fields are written in every other line from 1st line of the frame memory 803. Accordingly, the converted RGB data is stored as frame data of 30 Hz by integrating these odd/even fields each other.

However, there is such case as data of even fields are written from 1st line of the frame memory 803 and data of odd fields are written from 0th line of the frame memory 803.

Data read out from the frame memory 803 by a control of a MPU 807 is multi-value halftone processed to become a predetermined set gradation number by a halftone process unit 804. This gradation number depends on the resolution of the binary display device (FLCD) and is previously set in the halftone process unit 804.

For example, in a case where a horizontal resolution and a vertical resolution of the binary display device are 1280 and 960 respectively, the horizontal resolution and the vertical resolution of the display device become twice as large as those of an input image (640 and 480) respectively. Therefore, as to the horizontal direction, it is enabled to perform a 3-gradation expression by an area-gradation system by utilizing horizontal two pixels of the binary display device. As to the vertical direction, the binary display device is driven for two lines simultaneously.

In this case, 3-gradation is utilized as the gradation number. However, since a frame renewal rate of the binary display device becomes twice as large as that of an ordinary one line driving, the above-mentioned case becomes effective if the frame renewal rate of the binary display device is low.

Here, it will be explained in the above case a multi-value halftone process in the halftone process unit 804, a conversion process for converting data into binary data executed in a data conversion unit 805 and a method for lighting sub pixels in the binary display device, with reference to FIGS. 17A to 17D.

Figure 17A:
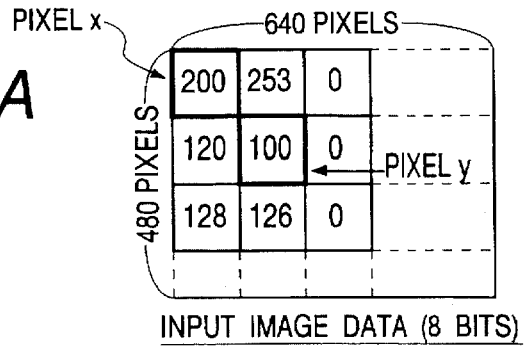
FIGS. 17A to 17D are views for explaining a process of a modified example 1.
Figure 17B:
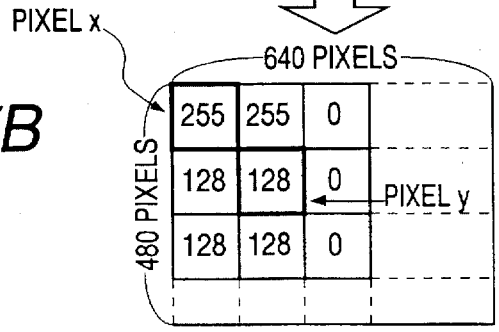
Figure 17C:
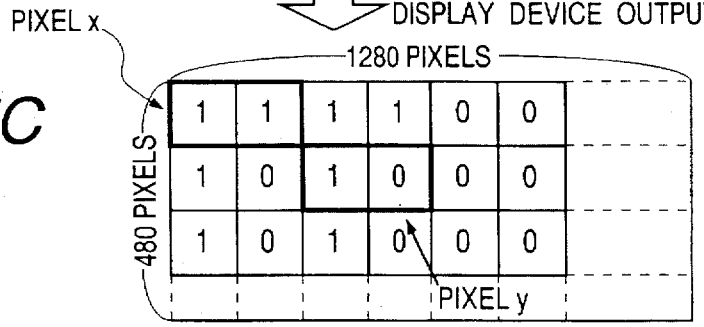
Figure 17D:
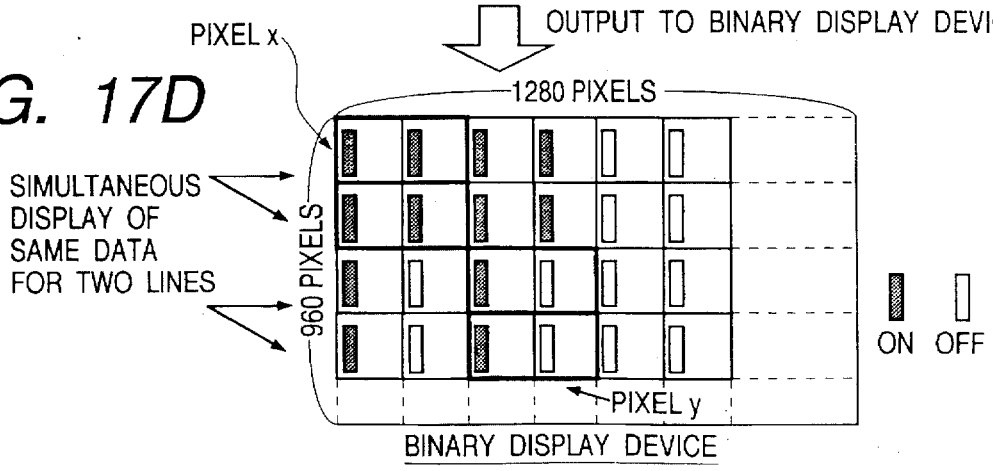

Among input image data shown in FIG. 17A, the value of input image data of a pixel x is 200, and in a case where this data is converted into data of 255 by executing a ternary halftone process, since this case corresponds to level 2 of a 3-gradation expression shown in FIG. 5, data is converted into such binary data as the both of two sub-pixels of the binary display device come to be lighted as shown in FIG. 17C. However, in this case, since data of which vertical resolution is 480 is displayed on the binary display device of which vertical resolution is 960 which is twice as large as 480, the same data is displayed for two lines of the binary display device simultaneously (refer to FIG. 17D).

In this manner, as to the horizontal direction, a multi-value gradation display can be performed even in the binary display device by executing a multi-gradationing process such that the resolution of input image data coincides with the resolution of a display device. As to the vertical direction, since multi-gradationing processed data is driven for plural lines simultaneously such that the resolution of the input image data coincides with the resolution of the display device, a renewal rate of the display device can be treated as the rate which is plural times as large as that of the case of one line driving. Therefore, even if the frame renewal rate of the display device is low like an FLCD, the frame can be renewed with the high speed. Particularly, in case of displaying an animation image, a smooth animating image can be displayed.

<MODIFIED EXAMPLE 2>

In the above-mentioned embodiment and a modified example 1, a binary display device is utilized as a display device, however, the present invention is not limited to such device. For example, the display device may be a multi-value (equal to or greater than ternary) display device.

As a modified example 2, it will be explained hereinafter the case for utilizing a 4-level display device. It should be noted that the structure of a display control apparatus corresponding to the present modified example is same as that of the apparatus corresponding to the above-mentioned embodiments.

Figure 18:
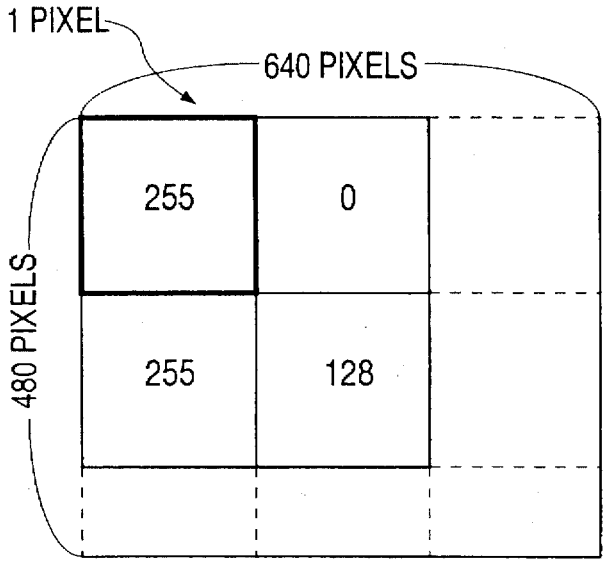
FIG. 18 shows input image data transmitted to a display control apparatus corresponding to a modified example 2.
Figure 19:
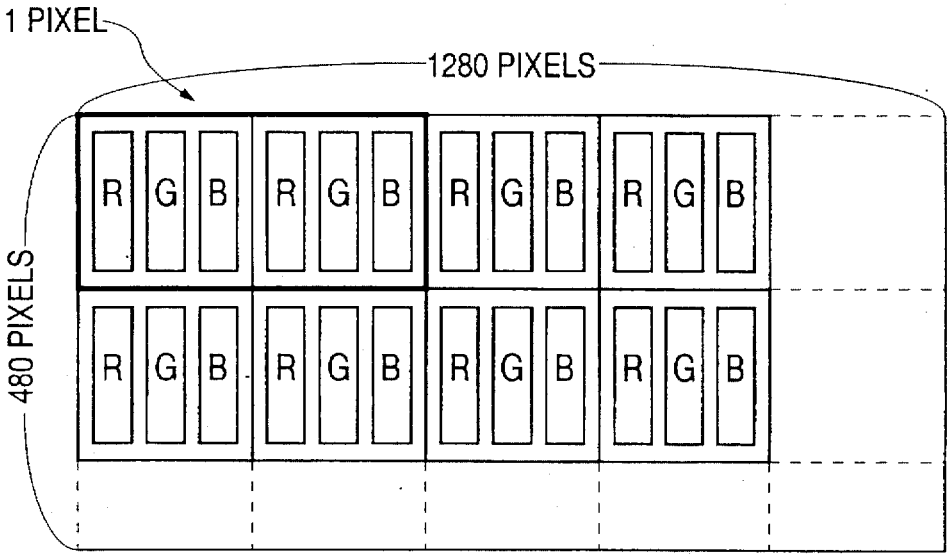
FIG. 19 shows the gradation of a display device corresponding to a modified example 2.

FIG. 19 shows a resolution of the display device corresponding to the present modified example. As shown in FIG. 19, a horizontal resolution and a vertical resolution of the 4-level display device are 1280 and 480 respectively, and as shown in FIG. 18, the horizontal resolution and the vertical resolution of input image data are 640 and 480 respectively. That is, it is assumed that the horizontal resolution of the display device is twice as large as that of the input image.

Figure 20:
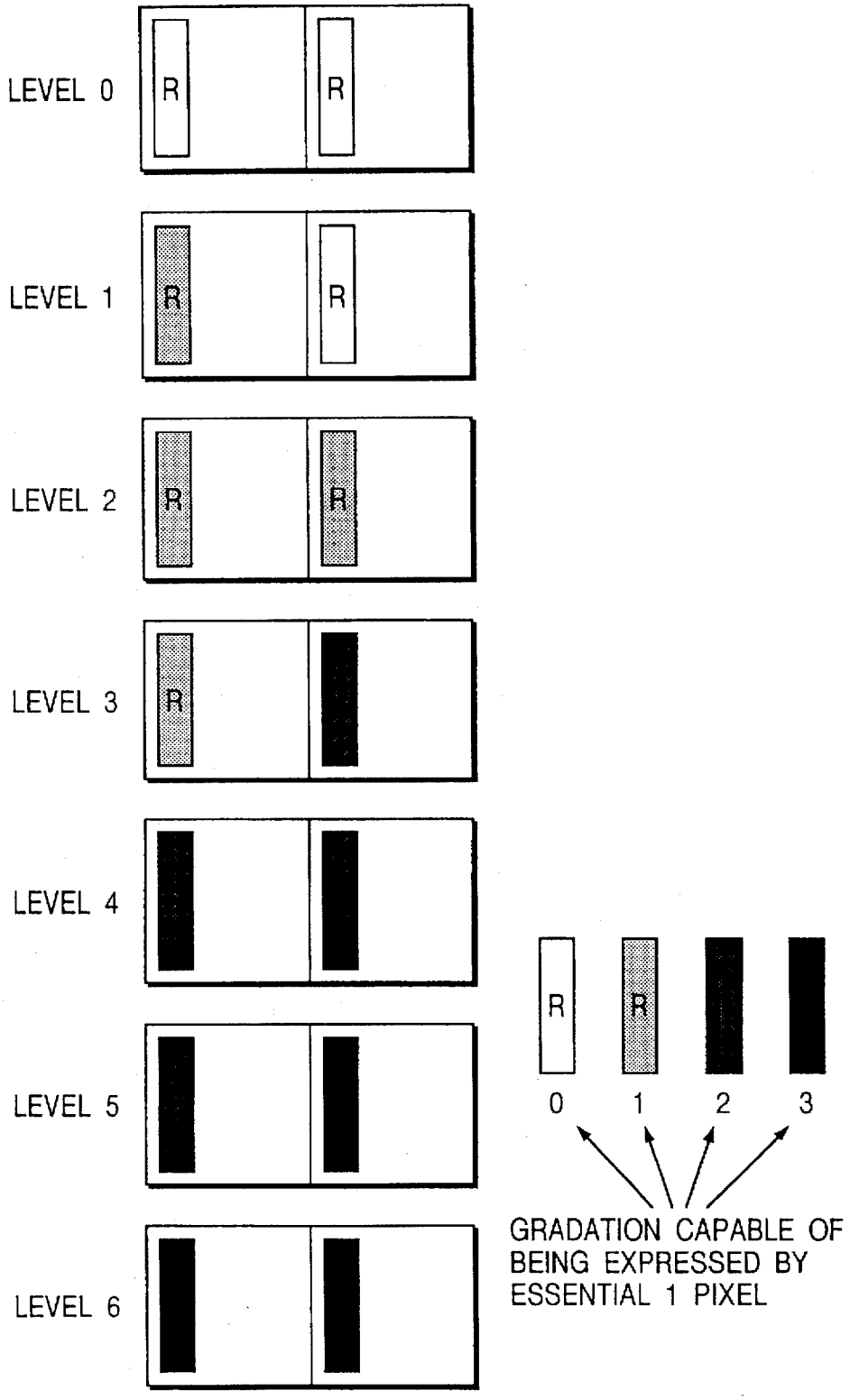
FIG. 20 shows a gradation expression corresponding to a modified example 2.

In this case, data of one pixel shown in FIG. 18 can be displayed in a seven-gradation display (level 0 to level 6) when it is assumed that the gradation number which can be originally expressed by one pixel is four shown in FIG. 20 (an image can be displayed for each of RGB colors) by one pixel shown in FIG. 19 (original two pixels in the horizontal direction can be used as one pixel).

Therefore, in case of utilizing the 4-level display device, a 7-level halftone process is to be executed similar to a multi-value halftone process in the above-mentioned embodiment and a modified example 1. Then 7-level halftone processed data is converted into 4-level data 0, 1, 2 and 3 of the 4-level display device by a data conversion unit 104.

It will be explained the conversion for converting data into data of the 4-level display device.

FIGS. 21A to 21D show the conversion for converting data into data of the 4-level display device in the present modified example. Among input image data shown in FIG. 21A, the value of input image data of a pixel x is 200. When this data is converted into data of 213 by executing the 7-level halftone process as in FIG. 21B, this corresponds to level 5 of a 7-gradation expression shown in FIG. 20.

Therefore, as shown in FIG. 20, in the present modified example, data is converted into such data as levels of two sub-pixels of the 4-level display device are summed up to 5. It should be noted that, in these two sub-pixels, one may be level 2 and the other may be level 3 and vice versa.

Figure 21A:
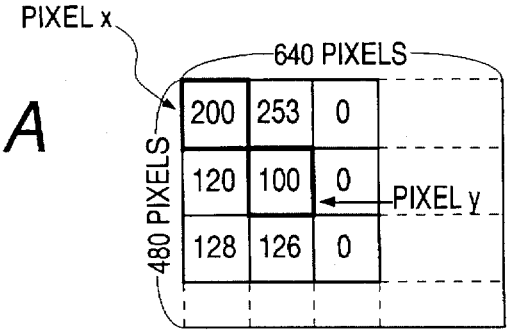
FIGS. 21A to 21D are views for explaining a process in which multi-value halftone processed data is converted into a format which can be output to a 4-level display device in a modified example 2.
Figure 21B:
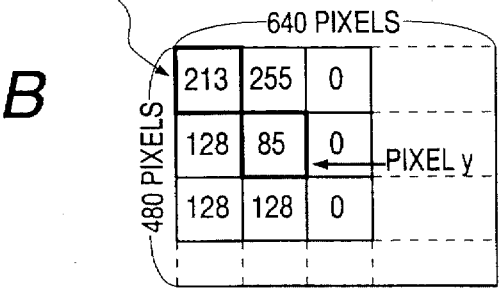
Figure 21C:
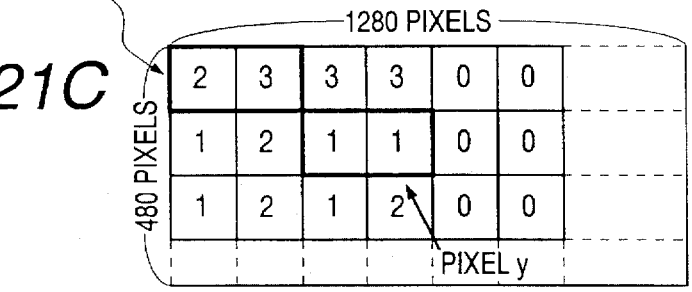
Figure 21D:
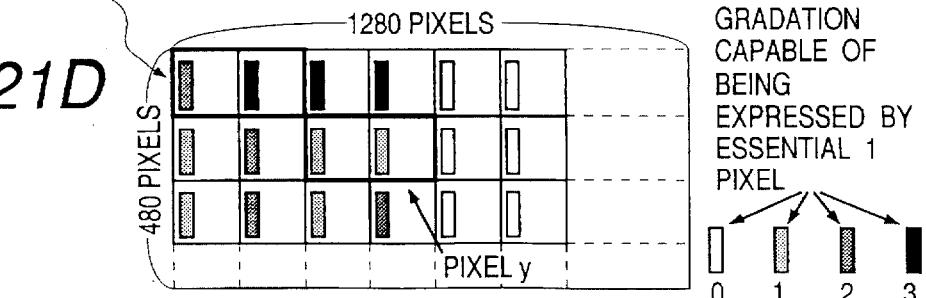

As shown in FIG. 21A, the value of input image data of a pixel y is 100. When this data is converted into data of 85 by executing the 7-level halftone process, since this case corresponds to level 2 of the 7-gradation expression shown in FIG. 20, data is converted into such data as levels of two sub-pixels of the 4-level display device are summed up to 2.

Figure 22:
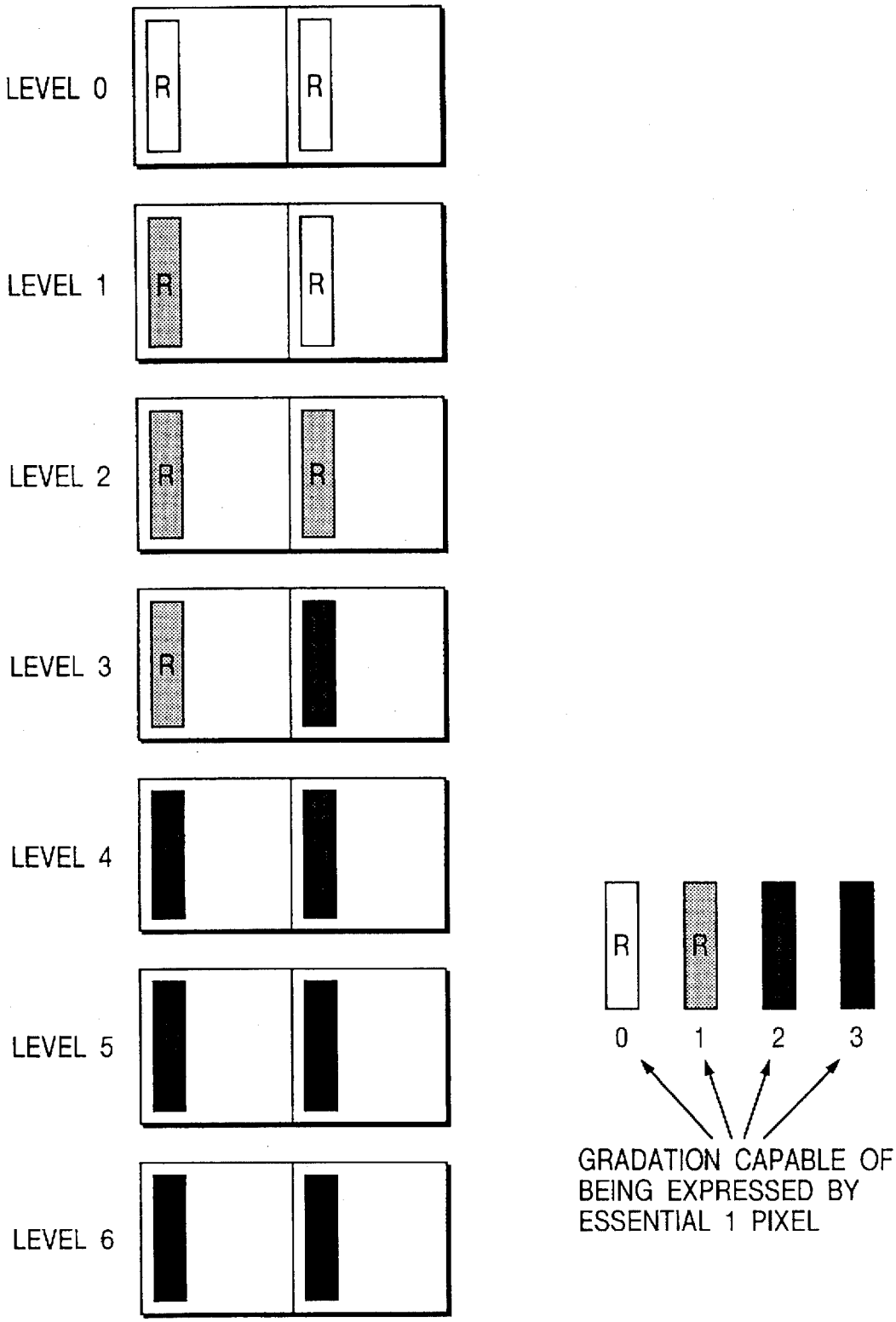
FIGS. 22 to 24 show examples for expressing the halftone area-gradationary by utilizing two sub-pixels.
Figure 23:
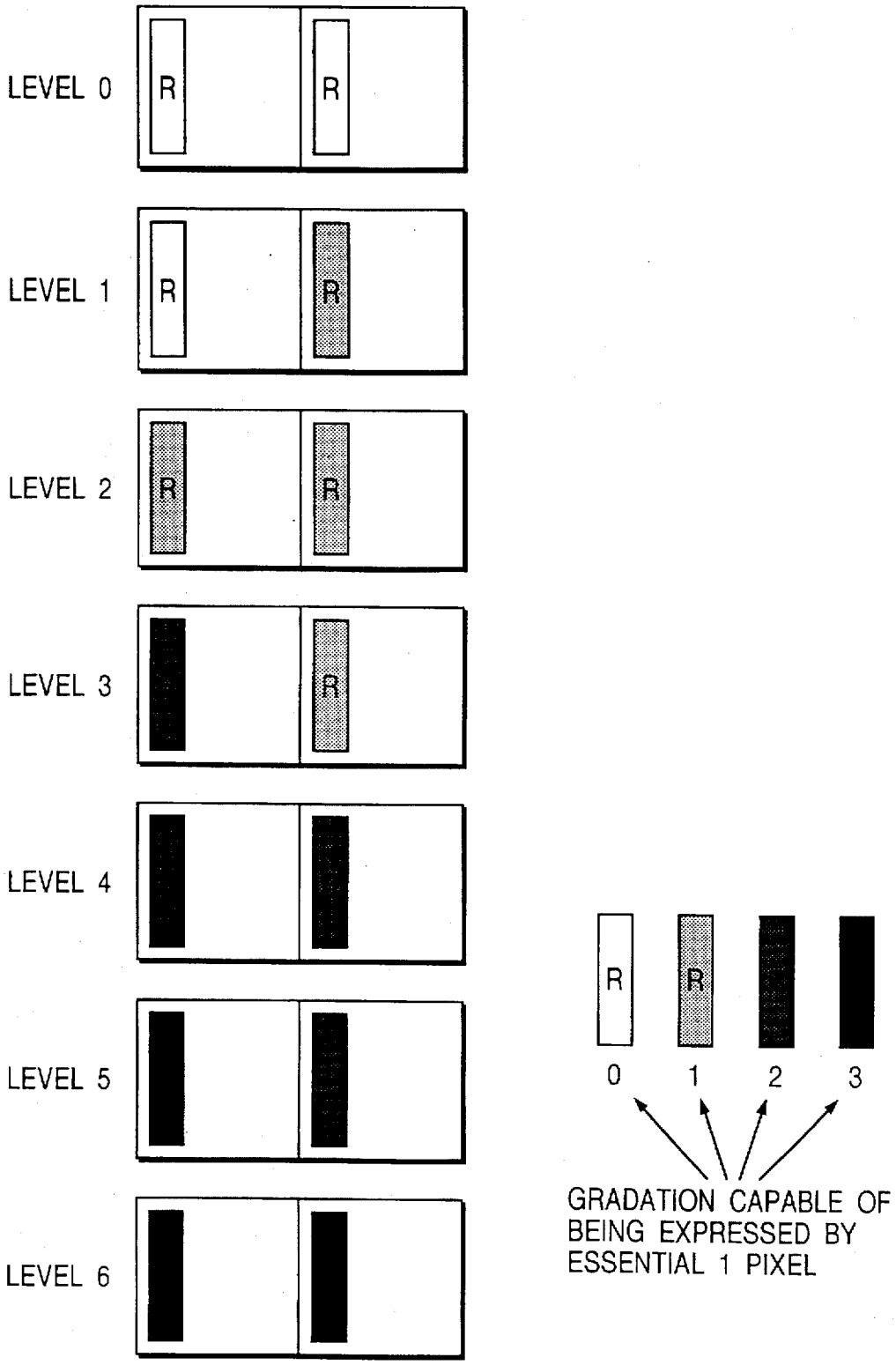
Figure 24:
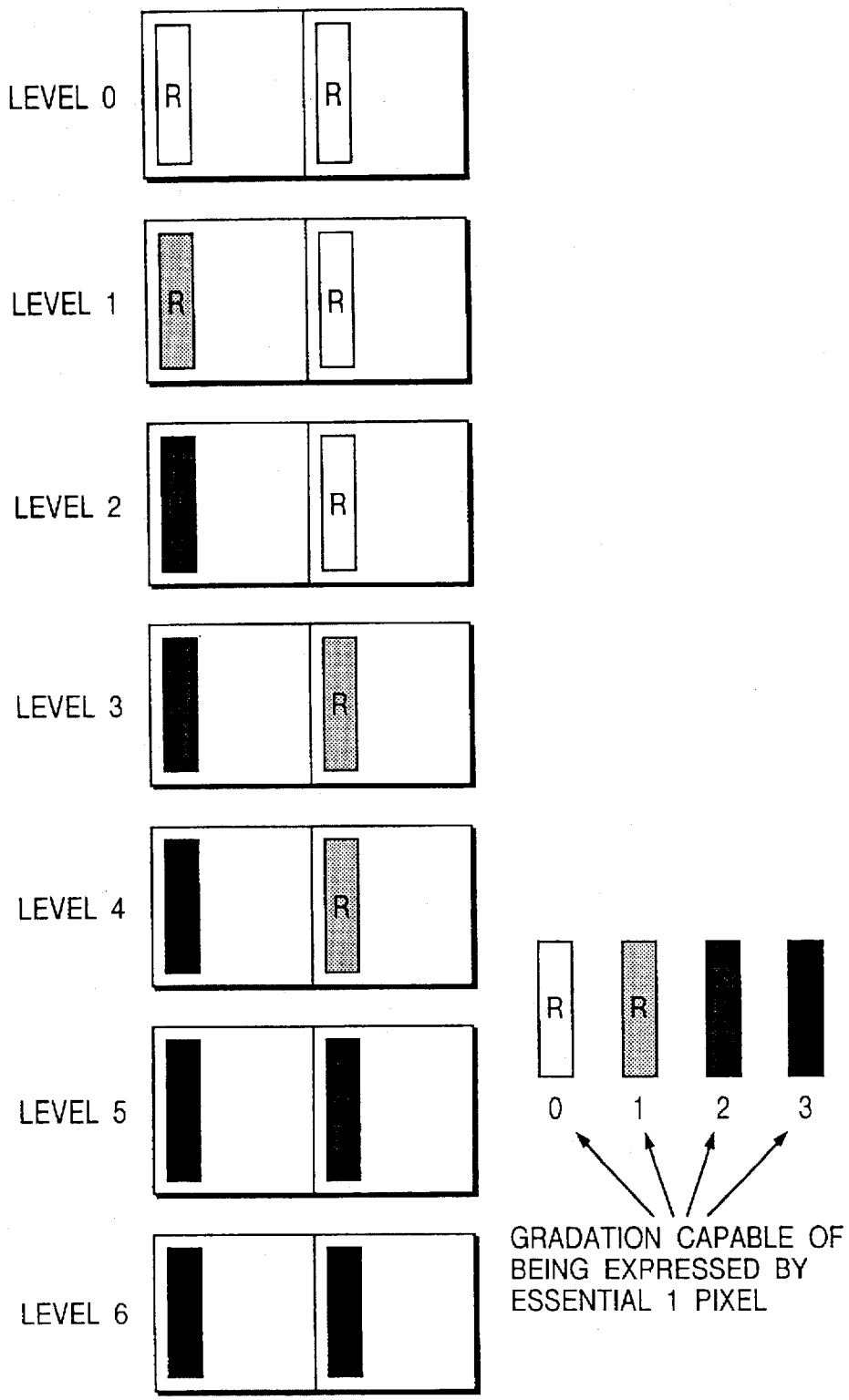

It should be noted that a gradation expression of this example is not limited to an example shown in FIG. 20, but may be a gradation, for example, shown in FIGS. 22 to 24.

As explained, the present invention can be applied to not only the binary display device but also the multi-value display device.

It should be noted that the present invention may be applied to the system composed of plural devices or to an apparatus composed of one device. Further, it is needless to say that the present invention can also be applied to the case which is attained by supplying the program to a system or an apparatus.

As described above, according to the present invention, in a case where a resolution of a display device is higher than that of an input image, an excellent image can be displayed by outputting an input image of which resolution is coincided with the resolution of the display device by executing a halftone process.

As mentioned above, the present invention is described based on the preferable embodiment. However, the present invention is not limited to the above mentioned embodiment, but can be modified in various manner within the scope of following claims.

What is claimed is:

1. A display control apparatus which displays input image data of a first resolution on a display having a second resolution higher than the first resolution, comprising:

calculation means for calculating a ratio of the first resolution to the second resolution;

determination means for determining a number of gradations on the basis of the ratio calculated by said calculation means, in a case where the display device displays one pixel data of the input image data;

processing mean for halftone processing the input image data to produce a value of the number of gradations determined by said determination means; and data conversion means for converting the halftone-processed image data into data having a form which can be displayed on the display device.

2. An apparatus according to claim 1, wherein said determination means determines the number of gradations which can be expressed by plural pixels on the display device, on the basis of the ratio calculated by said calculation means.

3. An apparatus according to claim 1, wherein the display device can perform a two-level display for one pixel.

4. An apparatus according to claim 1, wherein the display device can perform a multi-level (equal to or greater than ternary) display for one pixel.

5. An apparatus according to claim 1, wherein said processing means halftone processes the input image data in a multi-value error diffusion method.

6. An apparatus according to claim 1, wherein said processing means halftone processes the input image data in a multi-value dither method.

7. An apparatus according to claim 1, wherein the display device comprises a ferroelectric liquid crystal display.

8. An apparatus according to claim 1, further comprising input means for inputting image data transmitted from an external device.

9. An apparatus according to claim 8, wherein said input means inputs image data transmitted from a host computer.

10. An apparatus according to claim 8, wherein said input means inputs NTSC-type TV image data.

11. An apparatus according to claim 1, wherein said determination means determines the number of gradations which can be expressed by utilizing N×M pixels of the display device when a horizontal resolution of the display device is N times as large as that of the input image data and a vertical resolution of the display device is M times as large as that of the input image data, and said conversion means converts the halftone-processed image data into data of N×M pixels.

12. An apparatus according to claim 1, further comprising scanning means for display scanning the display device on the basis of data obtained by said data conversion means.

13. An apparatus according to claim 12, wherein said determination means determines the number of gradations which can be expressed by utilizing N pixels of the display device when a horizontal resolution of the display device is N times as large as that of the input image data and a vertical resolution of the display device is M times as large as that of the input image data, said conversion means converts the halftone-processed image data into data of N pixels, and said scanning means scans the converted data of N pixels simultaneously for M lines.

14. A display control apparatus which displays input image data of a first resolution on a display having a second resolution higher than the first resolution, comprising:

determination means for determining a number of gradations which can be expressed by utilizing N pixels of the display device when a horizontal resolution of the display device is N times as large as that of the input image data and a vertical resolution of the display device is M times as large as that of the input image data;

processing means for halftone processing the input image data to produce a value of the number of gradations determined by said determination means; and display means for setting one line of the halftone-processed image data as M lines of image data and simultaneously scanning and displaying the M lines of image data.

15. An apparatus according to claim 14, further comprising calculation means for calculating a ratio of the first resolution to the second resolution, and wherein said determination means determines the number of gradations in accordance with the calculated ratio.

16. An apparatus according to claim 14, wherein said processing means halftone processes the input image data in a multi-value error diffusion method.

17. An apparatus according to claim 14, wherein said processing means halftone processes the input image data in a multi-value dither method.

18. An apparatus according to claim 14, wherein the display device comprises a ferroelectric liquid crystal display.

19. A display control method for displaying input image data of a first resolution on a display having a second resolution higher than the first resolution, said method comprising:

a calculation step of calculating a ratio of the first resolution to the second resolution;

a determination step of determining number of gradations on the basis of the calculated ratio in a case where the display device displays one pixel data of the input image data;

a processing step of halftone processing the input image data to produce a value of the number of gradations determined in said determination step; and a data conversion step of converting the halftone-processed image data into data having a form which can be displayed on the display device.

20. A display control method for displaying input image data of a first resolution on a display having a second resolution higher than the first resolution, said method comprising:

a determination step of determining a number of gradations which can be expressed by utilizing N pixels of the display device when a horizontal resolution of the display device is N times as large as that of the input image data and a vertical resolution of the display device is M times as large as that of the input image data;

a processing step of halftone processing the input image data to produce a value of the number of gradations determined in said determination step; and a display step of setting one line of the halftone-processed image data as M lines of image data and simultaneously scanning and displaying the M lines of image data.

* * * * *

UNITED STATES PATENT AND TRADEMARK OFFICE

CERTIFICATE OF CORRECTION

PATENT NO. : 5,739,808

DATED : April 14, 1998

INVENTOR(S) : KAZUMI SUGA, ET AL.

It is certified that error appears in the above-identified patent and that said Letters Patent is hereby corrected as shown below:

AT [57] ABSTRACT

Line 14, "the a" should read --the--.

COLUMN 4

Line 41, " "3" " should read --"3".--.

COLUMN 5

Line 18, "b 2x2is" should read --2X2 is--.

COLUMN 10

Line 24, "number" should read --a number--.

Signed and Sealed this

First Day of December, 1998

*Attest:*

*Attesting Officer*

BRUCE LEHMAN

*Commissioner of Patents and Trademarks*